US010988289B2

(12) United States Patent
Yourist et al.

(10) Patent No.: US 10,988,289 B2
(45) Date of Patent: Apr. 27, 2021

(54) CHILD-RESISTANT CLOSURE DEVICE FOR A CONTAINER HAVING A TAPERED NECK PORTION

(71) Applicant: Graham Packaging Company, L.P., Lancaster, PA (US)

(72) Inventors: Sheldon Yourist, York, PA (US); Brian Hagan, York, PA (US); Ben Lewis, Manchester, PA (US); Anthony Schlies, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 0 days.

(21) Appl. No.: 16/177,512

(22) Filed: Nov. 1, 2018

(65) Prior Publication Data

US 2019/0144176 A1 May 16, 2019

Related U.S. Application Data

(60) Provisional application No. 62/585,208, filed on Nov. 13, 2017.

(51) Int. Cl.

| | |
|---|---|
| ***B65D 50/04*** | (2006.01) |
| ***B65D 41/06*** | (2006.01) |
| ***B65D 41/04*** | (2006.01) |
| ***B65D 50/06*** | (2006.01) |
| ***B65D 41/36*** | (2006.01) |

(52) U.S. Cl.

CPC ..... *B65D 50/048* (2013.01); *B65D 41/0485* (2013.01); *B65D 41/06* (2013.01); *B65D 41/36* (2013.01); *B65D 50/066* (2013.01); *B65D 2215/02* (2013.01); *B65D 2215/04* (2013.01); *B65D 2251/023* (2013.01)

(58) Field of Classification Search

CPC ..... B65D 41/06; B65D 41/36; B65D 50/048; B65D 41/0485; B65D 2215/02

USPC ..... 220/212.5; 215/396

See application file for complete search history.

(56) References Cited

U.S. PATENT DOCUMENTS 1,321,425 A * 11/1919 Ellis ..... B65D 41/06 215/332
3,438,538 A * 4/1969 Peters ..... B65D 51/242 220/288
5,449,078 A * 9/1995 Akers ..... B65D 41/06 215/222
5,664,694 A 9/1997 Bietzer et al.
(Continued)

OTHER PUBLICATIONS

International Search Report dated May 14, 2019 for international application No. PCT/US2018/059538 filed Nov. 7, 2018.

*Primary Examiner* — Jeffrey R Allen
(74) *Attorney, Agent, or Firm* — Stradley Ronon Stevens & Young, LLP

(57) ABSTRACT

A child-resistant closure device for a rigid plastic container having a tapered neck section and method of manufacture. The device has a substantially circular neck and inner lid surface. The neck includes anchors which engage with nodes on the inner lid surface. The tapered section of the neck acts as a spring engaging the nodes with the anchors. The closure device may be engaged by rotating the lid in relation to the neck. To disengage the closure device a simultaneous downward and rotational force must be applied. The lid and the container, including the closure, can be blow molded at the same time or separately.

20 Claims, 12 Drawing Sheets

(56) References Cited

U.S. PATENT DOCUMENTS

| | | | | |
|---|---|---|---|---|
| 6,729,487 | B1 | 5/2004 | Dischler | |
| 7,938,282 | B1 * | 5/2011 | Hawry | B65D 41/0485<br>215/305 |

* cited by examiner

CHILD-RESISTANT CLOSURE DEVICE FOR A CONTAINER HAVING A TAPERED NECK PORTION

RELATED APPLICATION

This application claims the benefit of priority to U.S. Provisional Patent Application Ser. No. 62/585,208, filed on Nov. 13, 2017, the contents of which are incorporated in this application by reference.

TECHNICAL FIELD

The present invention relates generally to rigid plastic packaging and, more particularly, to an improved child-resistant closure system for plastic containers.

BACKGROUND OF THE INVENTION

The use of cooperating locking lugs on safety closures and containers to prevent children from gaining access to the contents of the container is well known in the art. Pharmaceuticals, chemicals, and other items that could be harmful or undesirable for children to handle or ingest are examples of substances that are commonly packaged in containers or bottles having child-resistant or safety closures. But the locking mechanism must still allow adults with dexterity issues and the elderly to open the containers.

One type of locking mechanism uses a cap which a person must squeeze to release the lock, and then turn the cap on the container while still squeezing. These squeeze-and-lock mechanisms require strong fingers and good coordination between the squeezing and turning, either of which makes it difficult for seniors or those with dexterity issues (e.g., arthritis) to use caps with this type of locking mechanism.

Some containers use a locking mechanism that requires the user to visually align arrows or other indicia and then snap off the container's cap or lid. This type of locking mechanism requires good vision to align the arrows or other indicia, and sufficient finger strength and coordination to force the cap off the container. Each of those requirements also makes it difficult for seniors or those that are visually impaired to use containers and caps with this type of locking mechanism.

Another example of a child resistant closure and container is a push-and-turn system which is typically used for pill containers. This system requires that the closure or cap for the pill container be pushed axially downward and rotated at the same time. These locking mechanisms do not require the finger strength and coordination of the other locking mechanisms. They do require strength, however, to push down and release the locking mechanism. These containers are typically a two-piece, ramp-and-lug design. Essentially, the closure comprises an inner cap and an outer cap which are rotatably attached to one another. When the cap is pushed down against the container lip, the inner cap is compressed against the lip to allow enough movement to release the lock when the cap is turned. Such a design requires more force than is comfortable or desirable for some seniors. There is thus a need for an improved push-and-turn lock mechanism that is both child-resistant and accessible to those with dexterity issues.

These conventional locking containers and caps are also complex and/or costly to make. The caps are often made of two pieces snapped together or bonded together, or the mating parts of the container and cap require complex molding or expensive after-molding assembly. This is especially so with current push-and-turn prescription vials where the cap is made of two parts and the second part is a resilient inner piece that is compressed against the cap to provide the resilient locking force. There is thus a need for a container and cap that are simpler to manufacture, and that are preferably cheaper to make.

BRIEF SUMMARY OF THE INVENTION

To meet this and other needs, and in view of its purposes, a child-resistant closure system for a rigid plastic container having a neck with a tapered section that acts as a spring to engage nodes on a lid with anchors on the neck to produce a child-resistant closure system is disclosed. The force required to disengage the lock can be adjusted by varying the length and taper-angle of the tapered section and the type or thickness of plastic used. In further embodiments, a handle can be added to the lid and/or a grip added to the container to assist adults with dexterity issues with opening the container.

One non-limiting embodiment of a closure system for a container includes: (1) a neck defining an opening, and (2) a lid. The neck has a first end that is closer to the container than a second end. The outer surface of the neck has a tapered section, which provides a bias in a direction away from the container, beginning at the first end and tapering towards the second end. At least two anchors extend radially outward from the surface of the neck and are spaced a distance apart. The anchors have: (i) a first anchor part comprising an undercut, and (ii) a second anchor part comprising a stop. The second anchor part is adjacent the first anchor part. The lid has a sidewall defining an inner surface, the inner surface including at least two nodes a distance apart that extend radially inward. The closure system is engaged by the bias forcing the nodes towards the undercuts when the lid is positioned with the nodes below the undercut.

One non-limiting embodiment of a closure system for a container includes: (1) a substantially circular neck, and (2) a lid. The neck has a first end with a first diameter connected to the container and a second end opposite the first end, having a smaller second diameter, defining an opening through which an axis that may be substantially perpendicular passes. The outer surface (i.e., the surface further from the axis) of the neck has a tapered section beginning at the first end, tapering towards the second end, and terminating when the diameter of the tapered section is about the same as the second diameter. At least two anchors extend radially outward from the surface of the neck and are spaced a substantially equal distance apart relative to the axis. The lid has a surface for covering the opening, and a sidewall defining an inner surface of the lid that is substantially circular and includes at least two nodes spaced a substantially equal distance apart relative to the axis that extend radially inward for engaging the anchors where the tapered section provides a spring bias for pushing the nodes into the anchors when the lid is engaged with the neck and turned relative to the neck.

In another non-limiting embodiment the anchors can include a first part containing an undercut beginning on the side of the first section proximate to the first end and extending towards the second end and optionally a second part beginning at the first end and connecting to the first section at an edge of the first section proximate to the undercut. The second section can act as a stop and/or guide to prevent the node from being rotated past the undercut and/or guide the node to the entry of the undercut.

In a further non-limiting embodiment, the number of anchors and/or nodes is not restricted to two and the number of anchors to nodes may not be equal. In one embodiment, four nodes engage four anchors, however, non-limiting embodiments of the present invention can include 3, 4, 5, 6, or 8 anchors for engaging 3, 4, 5, 6, or 8 nodes. Furthermore, the anchors and/or nodes may be spaced an equal distance apart relative to the axis. For example, 3 anchors and/or nodes can be spaced about 120 degrees apart, 4 anchors and/or nodes can be spaced about 90 degrees apart, 5 anchors and/or nodes can be spaced about 72 degrees apart, 6 anchors and/or nodes can be spaced about 60 degrees apart, and 8 anchors and/or nodes can be spaced about 45 degrees apart. Such additional anchors and/or nodes and their spacing may increase the weight of the product in the container that can be supported by the closure system.

Another non-limiting embodiment includes adjustments to the angle of a node and/or the anchor. In another embodiment, the anchors and nodes are horizontal, however, non-limiting embodiments of the present invention may include anchors or nodes with an upward or downward angle. For example, a node can be angled towards the top of the lid. Conversely, an anchor can be angled towards the bottom of the container. Such adjustments to the horizontal angle of the nodes and anchors may provide for greater surface contact between the nodes and anchors which may increase the weight of the product in the container that can be supported by the closure system.

Further non-limiting embodiments include a lid with a handle, grip, notch, or any combination thereof attached to the surface for covering the opening. The surface for covering the opening may also include ribs which may transmit force applied in the direction of the axis towards the container radially outward across the surface for covering the opening, which may mitigate deflection of the top of the lid. Failure to mitigate deflection of the top of the lid may result in the nodes failing to bypass the locking feature when a downward force is applied.

In another non-limiting embodiment of the present invention, the diameter of the inner surface of the lid may be greater than 4 inches. Such a diameter may make the lid more difficult to grasp for children with smaller hands than adults with larger hands. Thus, the greater diameter potentially makes the container more difficult for a child to open.

Non-limiting embodiments also include containers and lids of any shapes. For example, the present closure system could be attached to a square, round, or oval-shaped container. The lid may also take on any shape provided the inner sidewall of the lid is circular or substantially circular.

Furthermore, non-limiting embodiments may also include the container which has secondary stops to prevent the nodes from rotating past the undercuts. Non-limiting examples of such secondary stops may include protuberances below the anchors on the container or neck extending radially outward from the axis which can engage with protuberances on the lid extending radially inward from the sidewall and located closer to the distal edge of the sidewall than the nodes.

In another non-limiting embodiment, the container includes a grip. Such a container grip used independently or in conjunction with a handle on the lid may assist adults with dexterity issues with opening the closure.

In a non-limiting embodiment, the closure can be manufactured by a blow molding process, including but not limited to, extrusion blow molding, injection blow molding, injection stretch blow molding, or any combination thereof. In one non-limiting embodiment the lid may be manufactured at the same time as the closure. Conversely, in another non-limiting embodiment the lid can be manufactured separately. Blow molding is not the only process which can be used to manufacture the closure. Indeed, in a non-limiting embodiment, the closure can be manufactured by an injection molding or rotational molding process.

It is to be understood that both the foregoing general description and the following detailed description are exemplary, but are not restrictive, of the invention.

BRIEF DESCRIPTION OF THE DRAWING

The invention is best understood from the following detailed description when read in conjunction with the accompanying drawing. It is emphasized that, according to common practice, the various features of the drawing are not to scale. On the contrary, the various features are arbitrarily expanded or reduced for clarity. Included in the drawing are the following figures.

DESCRIPTION OF THE INVENTION

Figure 1:
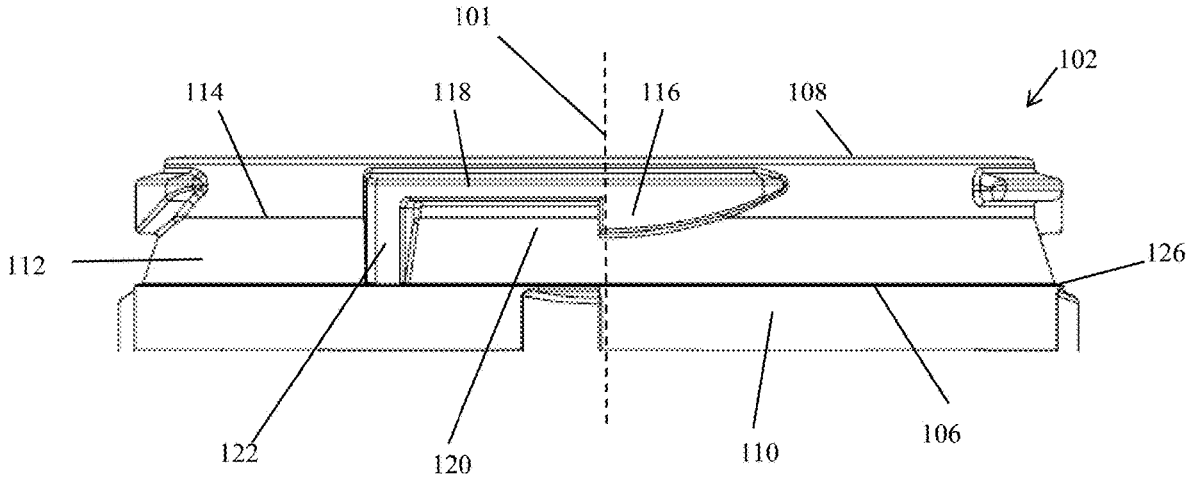
FIG. 1 is a side view of one embodiment of the neck.

The features and benefits of the disclosed closure system are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combinations of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

Figure 8A:
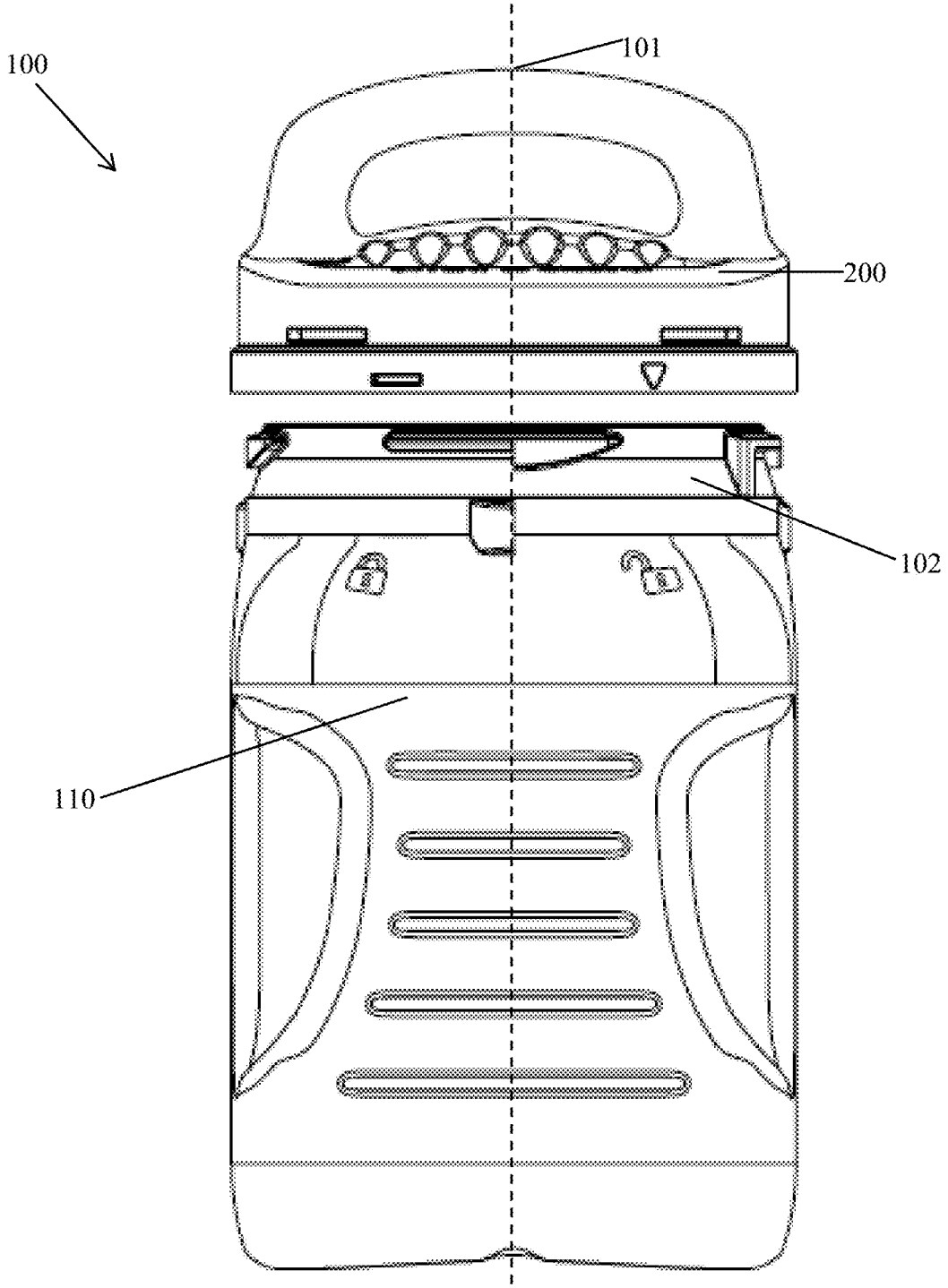
FIG. 8A is a rear view of one embodiment of the closure system with the lid removed.
Figure 8B:
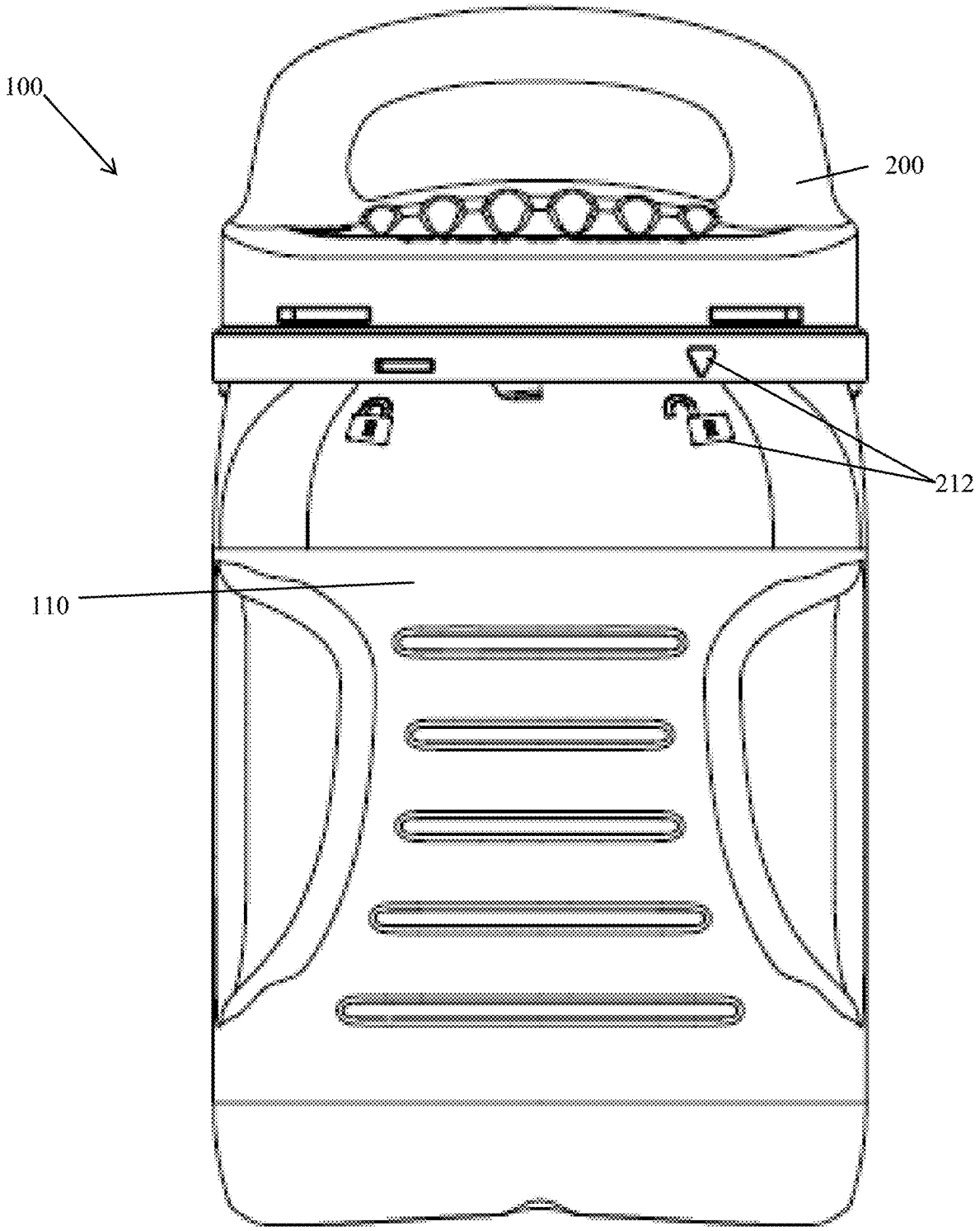
FIG. 8B is a rear view of one embodiment of the closure system in the unlocked position.
Figure 8C:
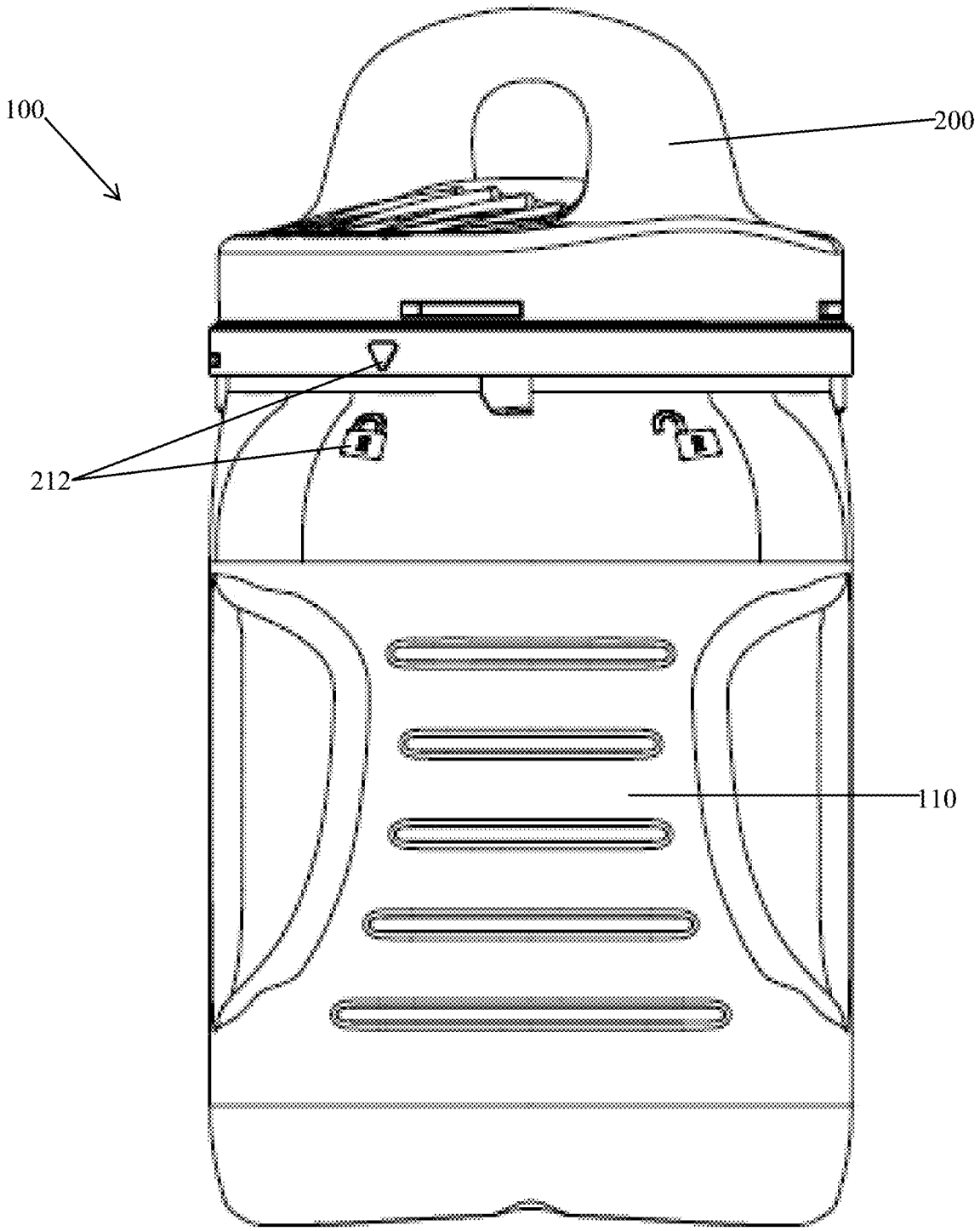
FIG. 8C is a rear view of one embodiment of the closure system in the locked position.

FIG. 8A depicts an exemplary embodiment of the closure system 100 according to the present disclosure. The closure system may be disposed upon a longitudinal axis 101 aligned in the z direction of a conventional cartesian x-y-z coordinate system. A cartesian coordinate system (X, Y, Z) is a coordinate system that specifies each point uniquely in three-dimensional space by three cartesian numerical coordinates, which are the signed distances to the point from three, fixed, mutually perpendicular directed lines, measured in the same unit of length. Each reference line is called a coordinate axis or just an axis of the system, and the point where they meet is its origin, usually at ordered triplet (0, 0, 0). The coordinates can also be defined as the positions of the perpendicular projections of the point onto the three axes, expressed as signed distances from the origin.

In a non-limiting embodiment, the closure system 100 incorporates a child-resistant closure with a rigid plastic container. In one non-limiting embodiment the lid can be blow molded at the same time as the closure and main body shape. The closure can also be blown separately. The ability to blow mold the lid and closure at the same time may provide cost savings. The lid of the container has protruding nodes which interact and lock into the body shape with undercuts (i.e., a locking feature) that accept the nodes. In one non-limiting embodiment, a clockwise turning motion pulls the lid down under an anchor; the nodes are then forced up into the undercuts by a tapered section of the container neck that acts as a spring. In another non-limiting embodiment, when the nodes engage with the undercuts an audible sound is produced.

To disengage the closure a downward force is needed to bypass the locking feature before the lid can be rotated for removal. In one non-limiting embodiment, the removal of the closure requires two simultaneous motions, a push down motion and a turn motion. The push down and turn motion requires more force and/or dexterity than a small child can exert, rendering the closure child-resistant and senior-friendly in meeting the needs of the child-resistive packaging (CRP) standards of the Consumer Products Safety Council. The disclosed closure may also be easier to carry, open, and close.

Neck Structure

FIG. 1 depicts an exemplary embodiment of the container neck 102 according to the present disclosure. The neck 102 is circular or substantially circular and defines an opening 104 (see FIG. 6) of a container 110. The neck 102 may be centered on an axis 101 that is perpendicular or substantially perpendicular to the opening 104. Conversely, the neck need not be centered on the axis 101. For example, the neck 102 may further include a pour spout resulting in a non-centered and/or non-circular opening.

The neck 102 has an inner surface and an opposite outer surface. Both the inner surface and the outer surface of the neck 102 can be parallel or substantially parallel to the axis 101.

The outer surface of the neck 102 includes a first end 106 having a first diameter and a second end 108 having a second diameter. The first end 106 is closer to the container 110 than is the second end 108. The first diameter is greater than the second diameter.

The outer surface of the neck 102 includes a tapered section 112 beginning at the first end 106, tapering towards the second end 108, and may terminate at a point 114 when the diameter of the tapered section 112 is about the same as the second diameter. In a non-limiting embodiment the angle from vertical at which the tapered section 112 tapers is between about 10 and 25 degrees. In one embodiment, the angle is between about 12 and 20 degrees. In another embodiment the angle is between about 15 and about 18 degrees from vertical. In a further embodiment, the angle is about 10, about 11, about 12, about 13, about 14, about 15, about 16, about 17, about 18, about 19, about 20, about 21, about 22, about 23, about 24, or about 25 degrees from vertical.

The taper section 112 is not required to be a continuous taper; it may contain a curve.

The outer surface of the neck 102 includes at least two anchors 116. The anchors 116 may be located a distance apart. The distance may be equal or substantially equal. For example, 3 anchors 116 can be spaced about 120 degrees apart, 4 anchors 116 can be spaced about 90 degrees apart, 5 anchors 116 can be spaced about 72 degrees apart, 6 anchors 116 can be spaced about 60 degrees apart, and 8 anchors 116 can be spaced about 45 degrees apart. Conversely, the anchors 116 may be spaced an irregular distance apart. For example, 4 anchors 116 may be located as follows when compared to a compass rose: 0 degrees, 100 degrees, 200 degrees, and 300 degrees. In one embodiment, however, the anchors 116 are a substantially equal distance apart.

The number of anchors 116 is also not restricted to two. In one embodiment, four nodes 204 engage four anchors 116, however, non-limiting embodiments of the present invention can include 3, 4, 5, 6, or 8 anchors 116 for engaging two or more nodes 204 on the lid 200. Such additional anchors 116 and their spacing may increase the weight of the product in the container 110 that can be supported by the closure system 100.

The anchors 116 extend radially outward from the outer surface of the neck 102. Although FIG. 1 depicts the anchor 116 as a bayonet lug, the anchor 116 may take on any suitable shape.

The anchors 116 include a first part 118 containing an undercut 120. The undercut 120 might also be called a channel, groove, notch, serif, or other similar name. The first section 118 may be perpendicular or substantially perpendicular to the axis 101. The first section 118 may also be angled in relation to the axis 101. The undercut 120 begins on the side of the first section 118 closest to the first end 106 and extends into the first section 118 towards the second end 108.

Although FIG. 1 depicts the undercut 120 as rectangular in shape, the undercut 120 is not restricted to such a shape. Indeed, the undercut 120 may take on any shape that can be engaged with the node 204. For example, the undercut 120 may be a triangle, square, cylinder, or circular shape.

In one embodiment, the first section 118 and the undercut 120 are horizontal, however, non-limiting embodiments of the present invention may include anchors 116 having a first section 118 or undercut 120 that are angled either upward or downward from horizontal. For example, the anchor 116 can have a first section 118 that may be angled towards the bottom of the container 110. Such a design of the anchor 116 may result in increased engagement between the nodes 204 and anchors 116 which may result in the closure 100 being able to support containers 110 containing products weighing in excess of twenty-five (25) pounds.

Optionally, the anchor 116 may include a second part 122 containing a stop. The second section 122 may be adjacent to the first section 116. In another non-limiting embodiment, the second section 122 may begin at the first end 106 and connect to the first section 118 at an edge of the first section 118 closest to the undercut 120. This second section 122 may also act as a stop and/or guide to prevent the node 204 from being rotated past the undercut 120 and/or guide the node 204 to the entry of the undercut 120. In a non-limiting embodiment, the second section 122 when engaged with a node 204 can withstand stripping torque up to 70 inch-pounds.

Figure 6:
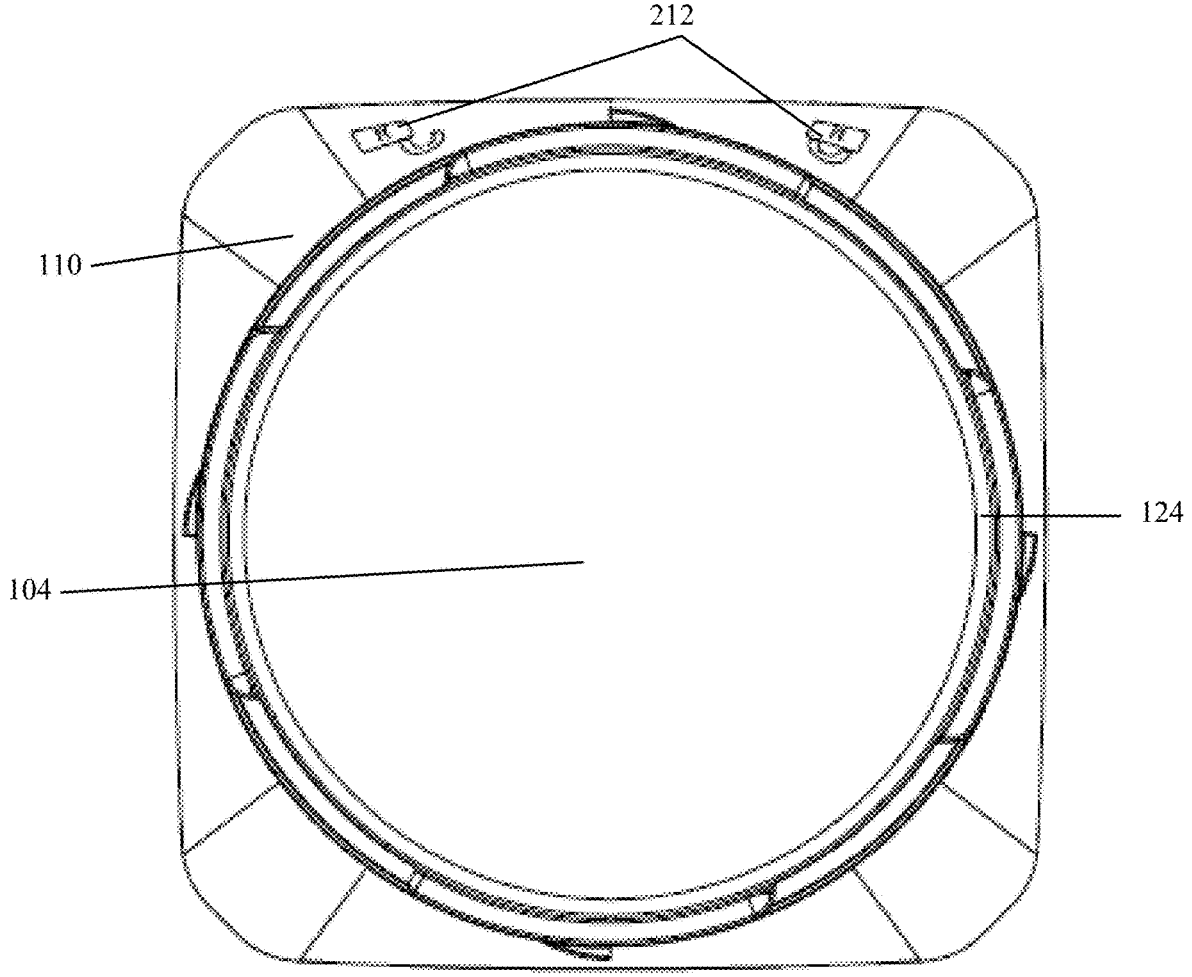
FIG. 6 is a top view of one embodiment of the neck connected to the container.

As shown in FIG. 6, a top lip 124 may also be attached to the neck 102. The top lip 124 is attached to the second end 108 and may project radially inward from the neck 102 towards the axis 101. Conversely, in non-limiting embodiments, the top lip 124 may project radially outward from the top lip 124. An induction seal may be attached to the top lip 124.

A bottom lip 126 may also be attached to the neck 102 and can be used to join the container 110 with the first end 106. The bottom lip 126 can project either radially inward or radially outward from the neck 102 depending on the shape of the container 110. Specifically, if the shape of the container 110 at the location to be joined with the neck 102 is narrower than the neck 102, the bottom lip 126 may project radially inward from the first end 106. Conversely, if the neck 102 is narrower than the shape of the container 110 at the location to be joined with the neck 102, the bottom lip 126 may project radially outward from the first end 106.

Lid Structure

Figure 2:
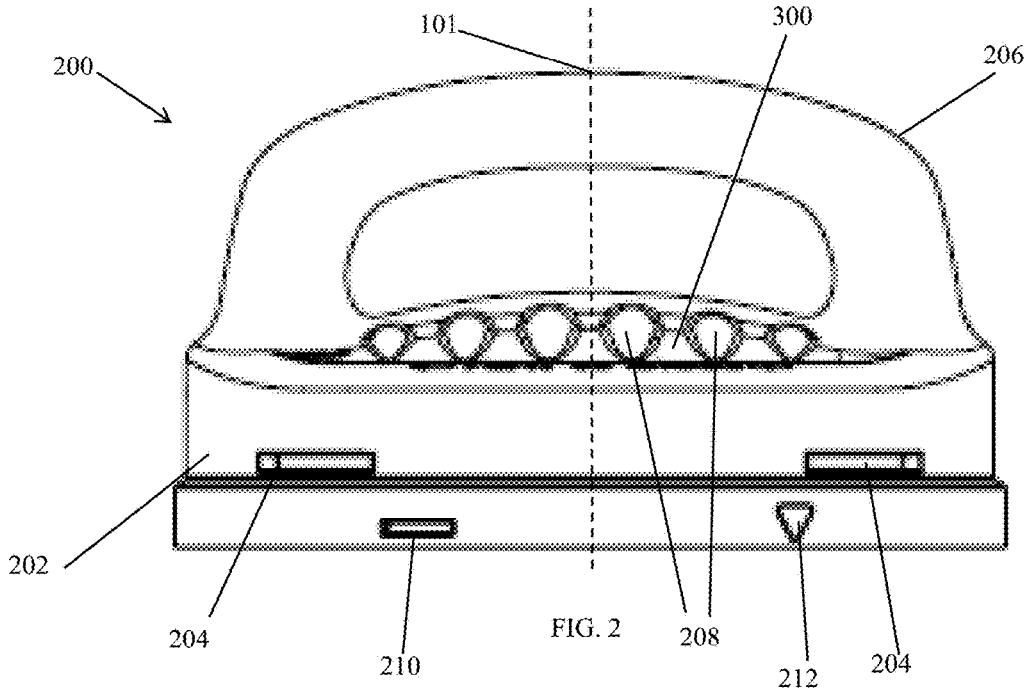
FIG. 2 is a front view of one embodiment of the lid.

FIG. 2 depicts an exemplary embodiment of the container lid 200 according to the present disclosure. The lid 200 has a surface 300 for covering the opening 104, and a sidewall 202. Similar to the neck 102, the sidewall 202 has both and inner and outer surface. Again, the inner surface of the sidewall 202 is the surface closest to the axis 101. Conversely, the outer surface of the sidewall 202 is the side furthest from the axis 101. The outer surface of the sidewall 202 can be any shape, however, the inner surface of the sidewall 202 will be circular or substantially circular.

In a non-limiting embodiment, the surface 300 for covering the opening 104 may have a diameter greater than four (4) inches. Such a diameter may make the lid 200 more difficult to grasp for children with smaller hands than adults with larger hands. Thus the greater diameter potentially makes the closure system 100 more difficult for a child to open.

The inner surface of the lid 200 includes at least two nodes 204. The nodes 204 may be located a distance apart. The distance may be equal or substantially equal. For example, 3 nodes 204 can be spaced about 120 degrees apart, 4 nodes 204 can be spaced about 90 degrees apart, 5 nodes 204 can be spaced about 72 degrees apart, 6 nodes 204 can be spaced about 60 degrees apart, and 8 nodes 204 can be spaced about 45 degrees apart. Conversely, the nodes 204 may be spaced an irregular distance apart. For example, 4 nodes 204 may be located as follows when compared to a compass rose: 0 degrees, 100 degrees, 200 degrees, and 300 degrees. In another embodiment, however, the nodes 204 are a substantially equal distance apart.

The number of nodes 204 is also not restricted to two. In one embodiment, four nodes 204 engage four anchors 116, however, non-limiting embodiments of the present invention can include 3, 4, 5, 6, or 8 nodes 204 for engaging two or more anchors 116 on the neck 102. Such additional nodes 204 and their spacing may increase the weight of the product in the container 110 that can be supported by the closure system 100.

The nodes 204 extend radially inward from the inner surface of the sidewall 202. Although FIG. 2 depicts the nodes 204 as rectangular in shape, the nodes 204 are not restricted to such a shape. Indeed, a node 204 may take on any shape that can be engaged with the undercut 120. For example, the node 204 may be a triangle, square, cylinder, or circular shape.

In one embodiment, the nodes 204 are horizontal, however, non-limiting embodiments of the present invention may include nodes 204 that are angled either upward or downward from horizontal. For example, a node 204 may be pitched towards the surface 300 for covering the opening 104. Such an design of the nodes 204 may result in increased engagement between the nodes 204 and anchors 116 which may result in the disclosed closure 100 being able to support containers 110 containing products weighing in excess of twenty-five (25) pounds.

In the non-limiting exemplary embodiment depicted in FIG. 2, the container lid 200 includes a handle 206. In non-limiting embodiments, the handle 206 may be replaced with a grip, knob, or other notched feature which a user may grasp for the purposes of opening, closing, or carrying the container 110.

Figure 3A:
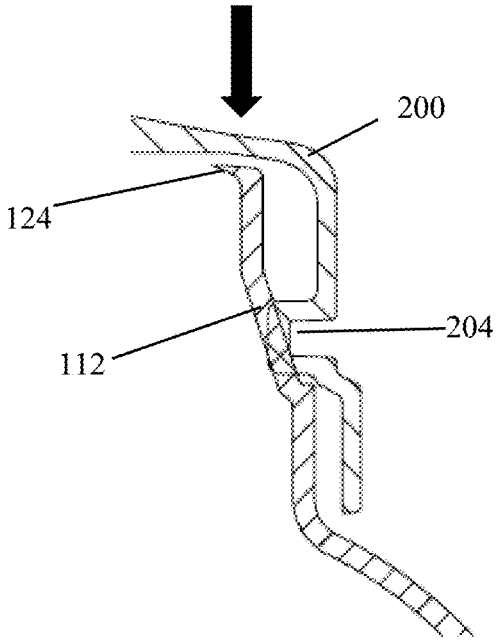
FIG. 3A is a cross sectional view of one embodiment of the closure system in the unlocked position and depressed via an external force applied in the direction of the arrow, taken along the line C-C of FIG. 4A.
Figure 3B:
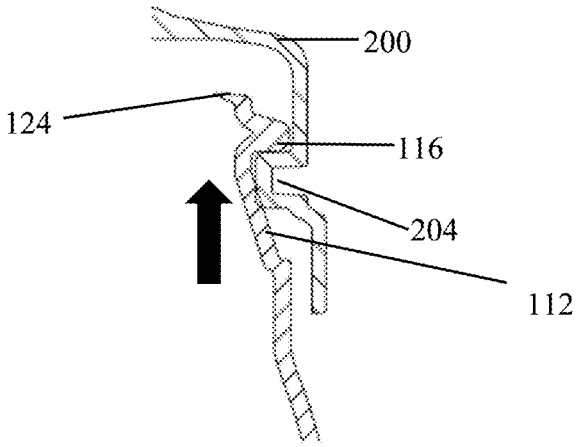
FIG. 3B is a cross sectional view of one embodiment of the closure system in the locked position with the node and anchor engaged via force applied by the tapered section in the direction of the arrow, taken along the line D-D of FIG. 4B.
Figure 4A:
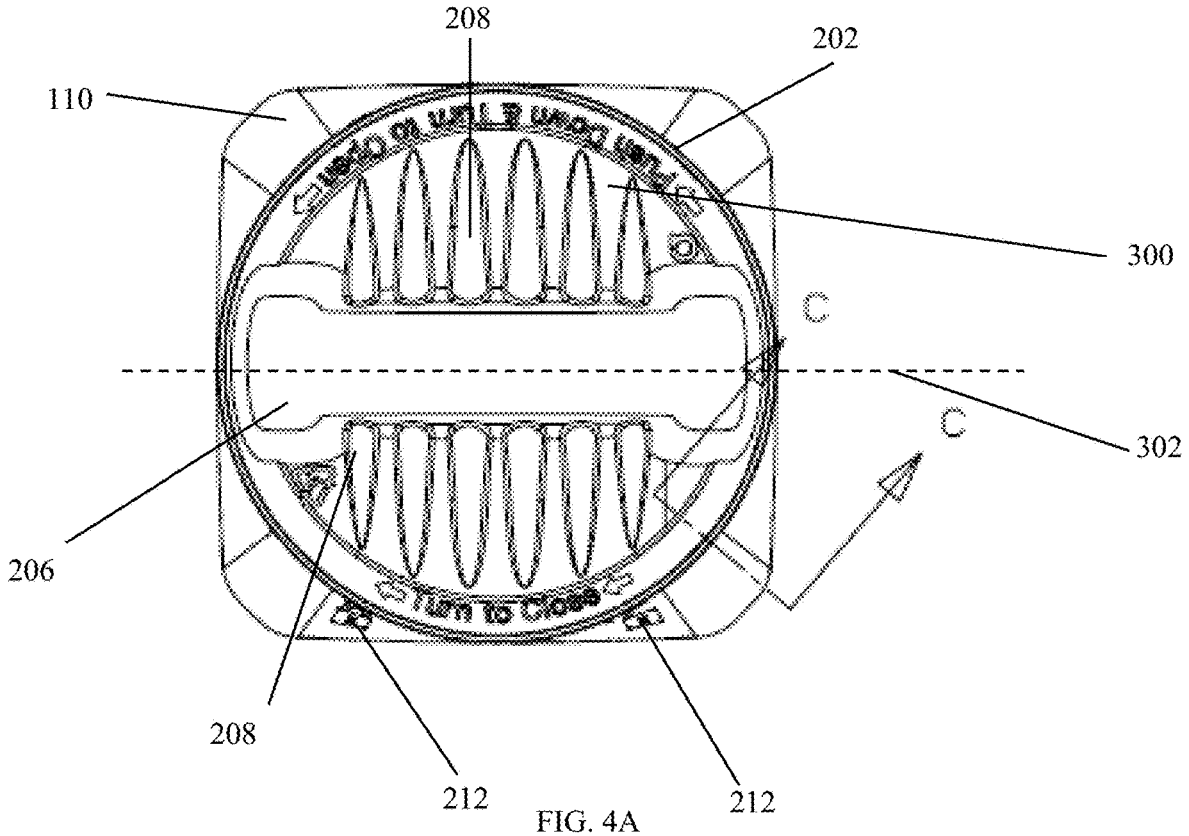
FIG. 4A is a top view of one embodiment of the closure in the unlocked position.
Figure 4B:
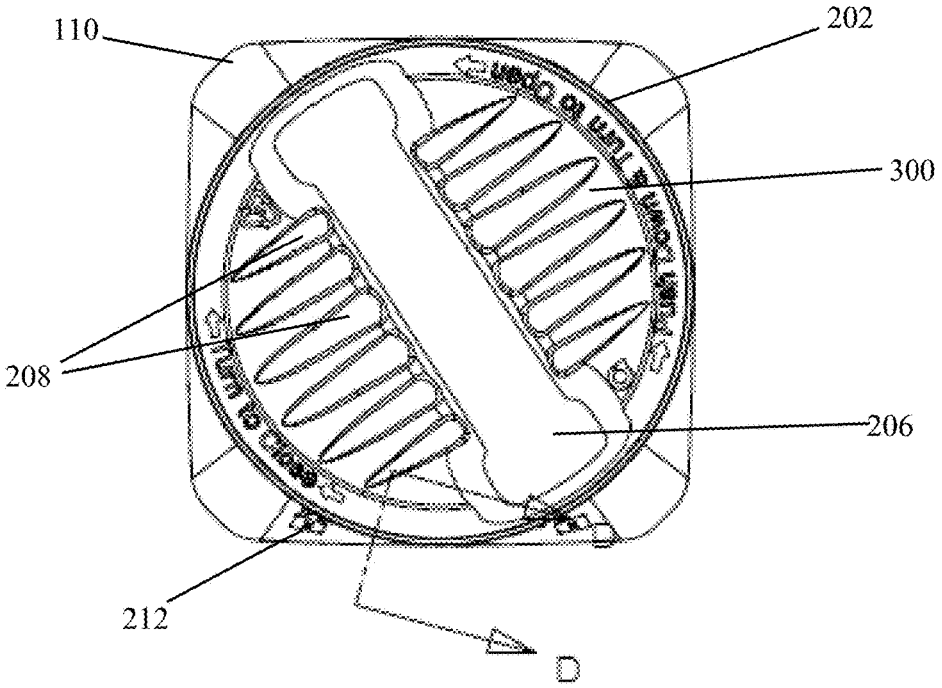
FIG. 4B is a top view of one embodiment of the closure in the locked position.

In the non-limiting exemplary embodiment depicted in FIGS. 2, 3A, and 3B, the container lid 200 includes a plurality of ribs 208. The ribs 208 extend outward from the surface 300 for covering the opening 104 in the direction of the axis 101. The ribs 208 extend from a center line 302 (see FIG. 4A) of the lid 200 outward towards the sidewall 202. In one non-limiting embodiment, the ribs 208 terminate before touching the sidewall 202. Conversely, the ribs 208 may not terminate until they reach the sidewall 202. The ribs 208 may be designed to transmit force applied in the direction of the axis 101 towards the container 110 radially outward across the surface 300 for covering the opening 104, which may mitigate deflection of the lid 200. Failure to mitigate deflection of the lid 200 may result in the nodes 204 failing to bypass the anchors 116 when a downward force is applied. Indeed, the lid 200 itself may be designed to withstand a strong downward force without substantial deflection thereby satisfying child-resistant package standards.

FIG. 2 further depicts an exemplary embodiment of the lid 200 including a lid stop 210. The lid stop 210 may engage with a container stop 412 to prevent the node 204 from being rotated past the undercut 120 and/or prevent the node 204, when it is engaged with the second section 122 of the anchor 116, from being stripped or deformed or stripping or deforming the second section 122.

Node/Anchor Engagement

As depicted in FIGS. 3A and 3B, the closure system 100 is engaged by first contacting the lid 200 and the neck 102. The closure system may then be engaged by applying a downward force on the lid 200 causing a deflection and/or deformation of the tapered section 112 and/or nodes 204 thereby permitting the nodes 204 to be simultaneously rotated to bypass the anchors 116. The rotation of the lid 200 continues until the nodes 204 are beneath the undercut 120. Finally, the downward force is removed thereby permitting the tapered section 116 to return to its original shape thereby imparting an upward force and engaging the nodes 204 with the undercut 120 (see FIG. 3B).

In an alternate non-limiting embodiment, a downward force is not required to engage the closure system 100. Instead the anchors 116 may contain a ramp section angled towards the first edge, such as a bayonet lug. In such an embodiment, when a rotational force is applied the ramps guide the nodes 204 against the force being imparted by the tapered section 112 below the anchors 116. When the node 204 reaches the undercut 120, the force imparted by the tapered section 112 engages the node 204 and the anchor 116.

To disengage the closure system 100 a downward force is needed to bypass the locking feature before the lid 200 can be rotated for removal. In a non-limiting embodiment, the closure system 100 is disengaged by applying a downward force to the lid 200 and simultaneously rotating the lid 200.

In a non-limiting embodiment, the closure system 100 may be engaged by rotating the lid 200 clockwise in relation to the neck 102 or counterclockwise in relation to the neck 102. Conversely, the closure system 100 may be disengaged by applying a downward force to the lid 200 and simultaneously rotating the lid 200 clockwise in relation to the neck 102 or counterclockwise in relation to the neck 102.

In a non-limiting embodiment, the anchors 116 may have a height of between about 0.1 mms and about 10 mms from the outer surface of the neck 102. In another embodiment, the anchors 116 may have a height of between about 2.0 mms and about 6.0 mms from the outer surface of the neck 102. In a further embodiment, the anchors 116 may have a height of between about 3.0 mms and about 5.0 mms from the outer surface of the neck 102. In another embodiment, the anchors 116 may have a height of about 4.2 mms from the outer surface of the neck 102.

In a non-limiting embodiment, the nodes 204 may have a height of between about 0.1 mms and about 10 mms from the inner surface of the sidewall 202. In another embodiment, the nodes 204 may have a height of between about 3.0 mms and about 8.0 mms from the inner surface of the sidewall 202. In a further embodiment, the nodes 204 may have a height of between about 5.0 mms and about 7.0 mms from the inner surface of the sidewall 202. In another embodiment, the nodes 204 may have a height of about 6.5 mms from the inner surface of the sidewall 202.

Container Structure

Figure 7:
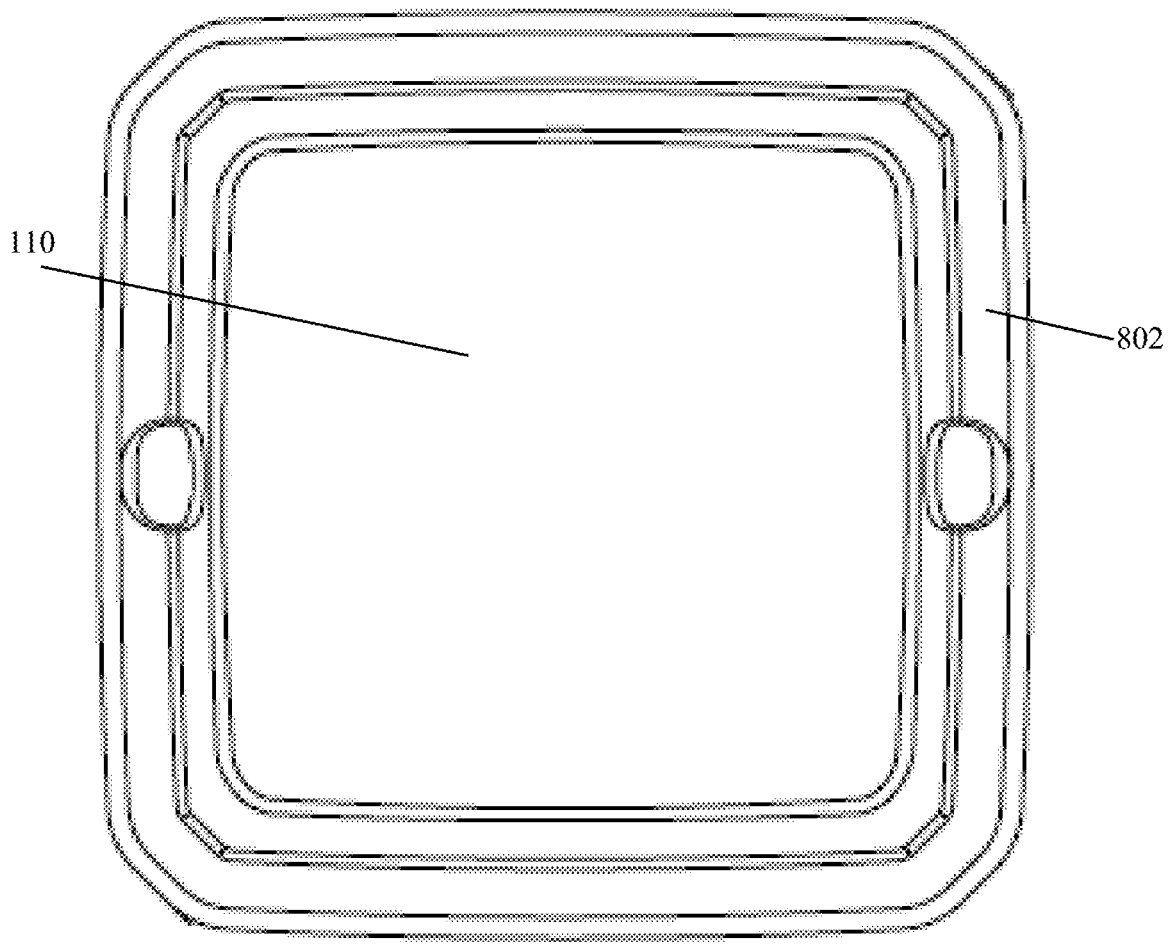
FIG. 7 is a bottom view of one embodiment of a container.

As depicted in FIGS. 6 and 7, the container 110 can be in a square shape (i.e., a square with rounded edges). The present invention is not restricted, however, to containers 110 having a square shape. The container 110 can comprise any shape that can be blow molded. For example, the shape of the container 110 can incorporate triangular, spherical, cylindrical, rectangular, or oval shapes. Furthermore, as outlined above, the lid 200 for the container 110 can also take on any outer shape. A limitation to the design of the container 110 and the lid 200 is the outer surface of the container neck 102 must be circular or substantially circular and the inner surface of the lid 200 that engages with the neck 102 must be circular or substantially circular.

FIGS. 5A, 5B, 5C, and 5D depict an exemplary embodiment of the container 110 including a grip 408 on the container 110. This grip 408 may aid the user in holding the container 110 when attaching or removing the lid 200. The grip 408 and/or the container 110 may incorporate structural ribs 410 which extend radially inward towards the axis 101.

Figure 5A:
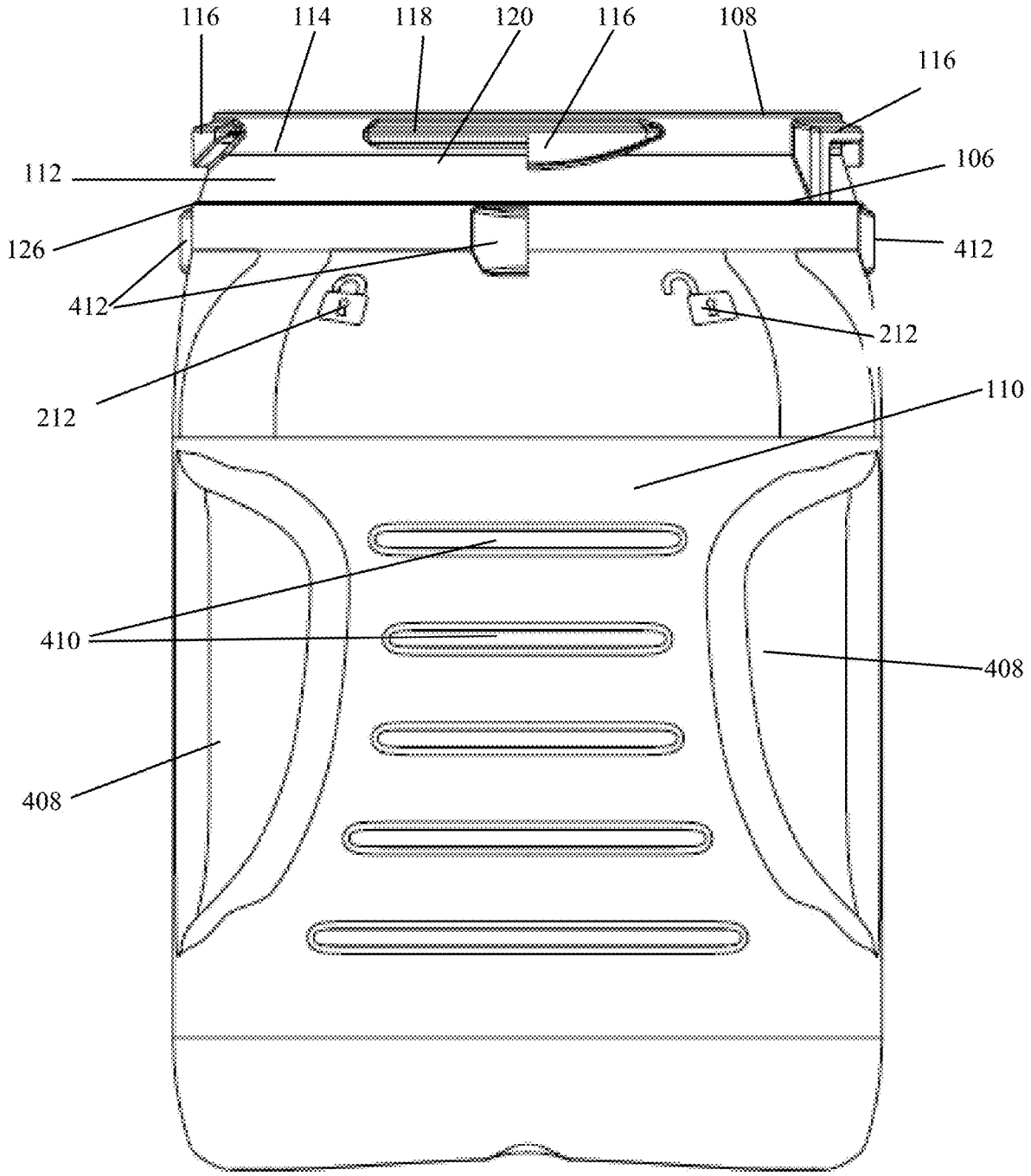
FIG. 5A is a rear view of one embodiment of the neck connected to the container.
Figure 5B:
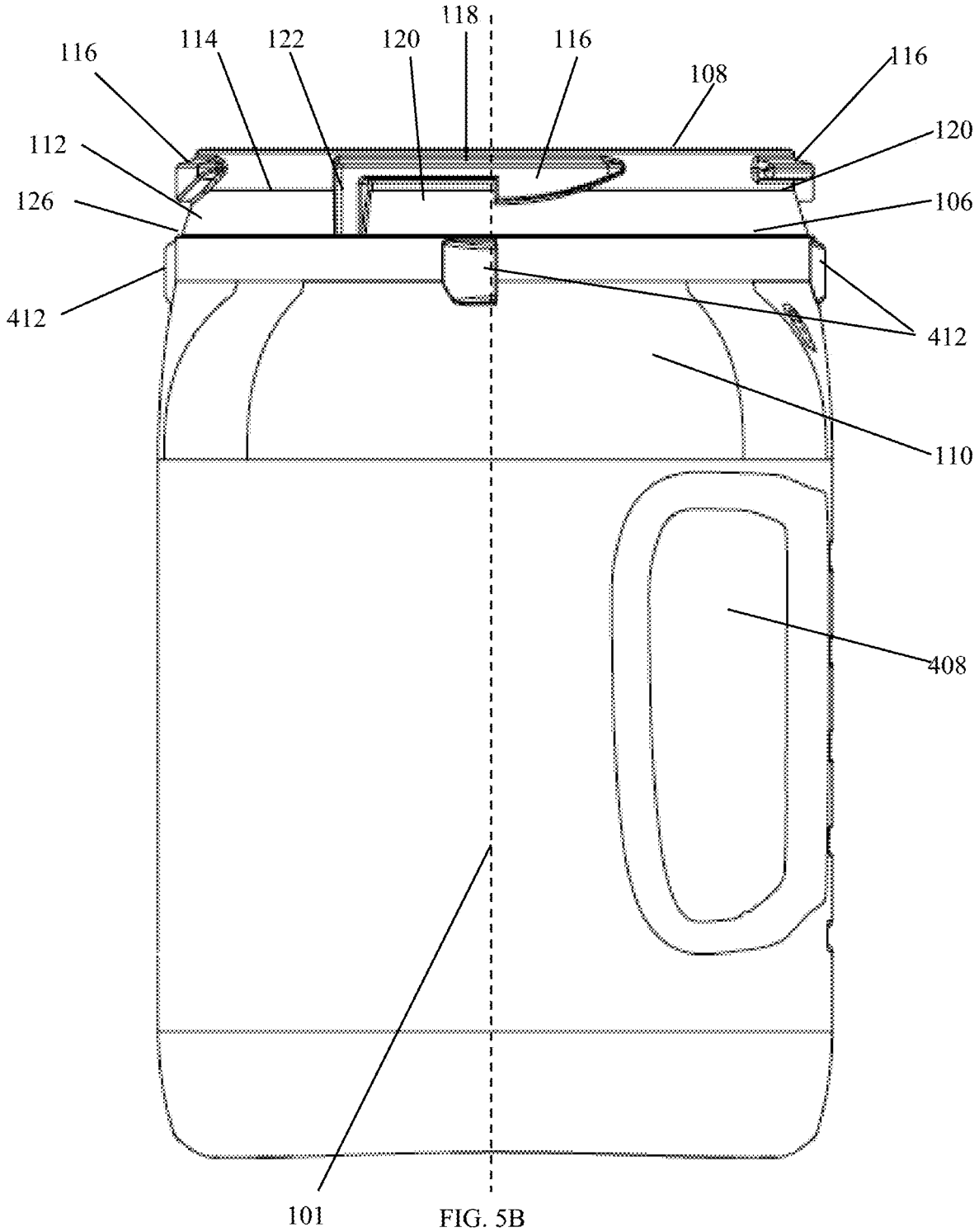
FIG. 5B is a side view of one embodiment of the neck connected to the container.
Figure 5C:
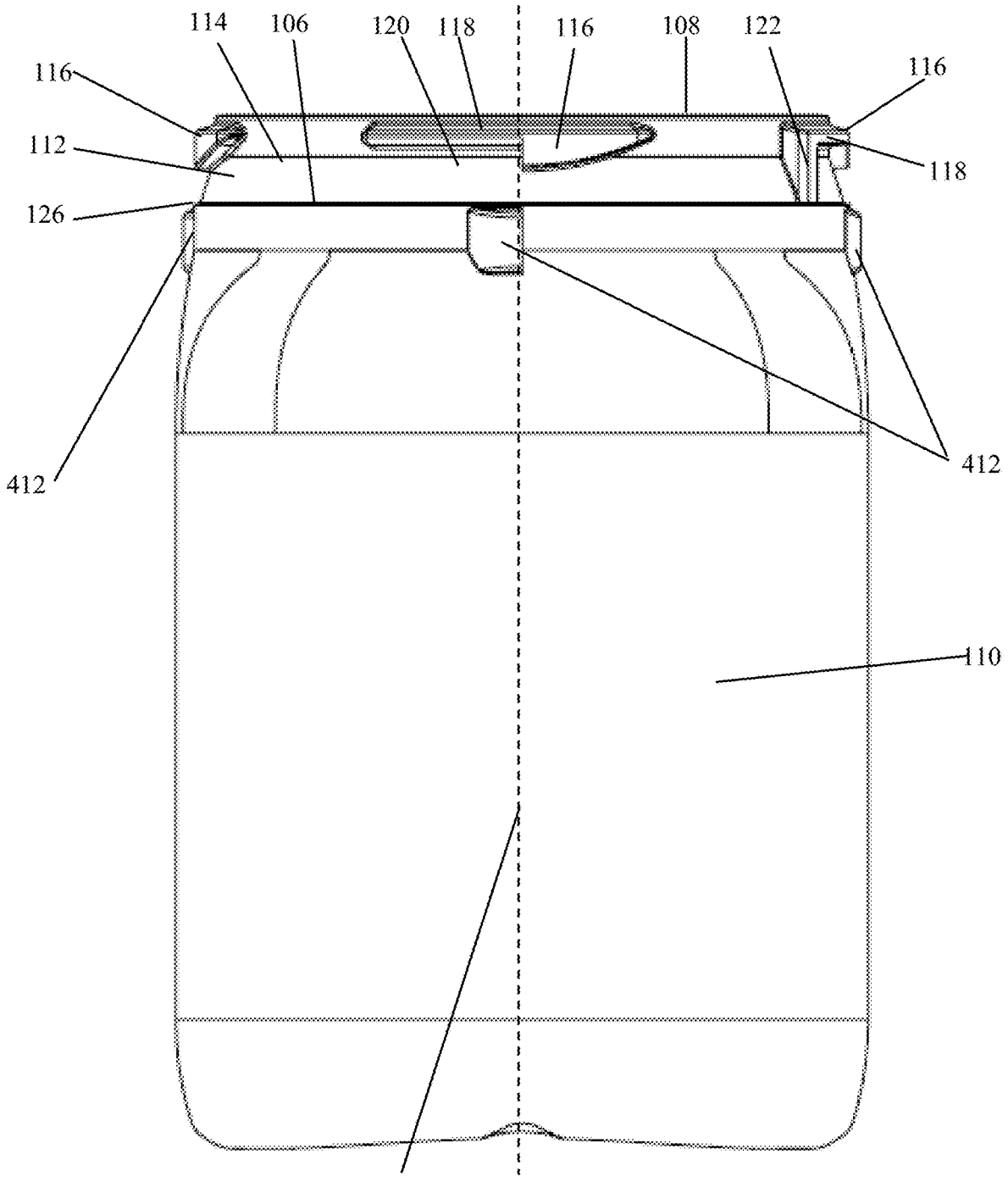
FIG. 5C is a front view of one embodiment of the neck connected to the container.
Figure 5D:
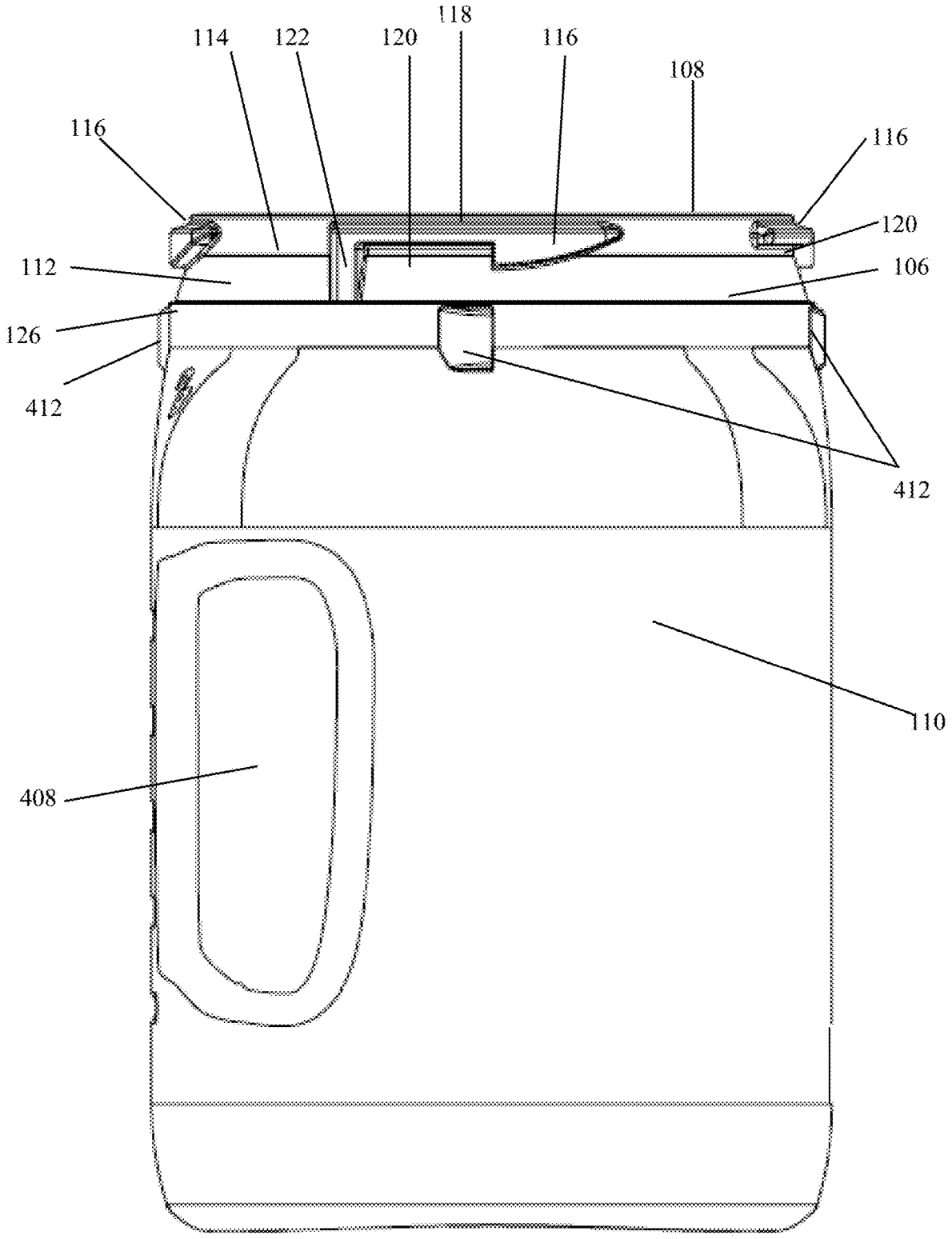
FIG. 5D is a side view of one embodiment of the neck connected to the container.

FIG. 5A depicts an exemplary embodiment of the container 110 including the container stop 412. This container stop 412 may engage with the lid stop 210 to prevent the node 204 from being rotated past the undercut 120 and/or prevent the node 204, when it is engaged with the second section 122, from being stripped or deformed or from stripping or deforming the second section 122.

In a non-limiting embodiment, one or more markers 212 may be added to the container 110 and the lid 200. The alignment of the markers 212 on the lid 200 and the markers 212 on the container 110 may signal that the closure system 100 is in the open or closed position. The markers 212 may be any design. For example, the marker 212 may be words, numbers, arrows, diamonds, triangles, circles, logos, or locks depicted in either a locked or unlocked orientation.

FIG. 7 depicts an exemplary embodiment of the bottom of the container 110. In a non-limiting embodiment, the bottom of the container 110 may be flat or substantially flat. In another non-limiting embodiment the base of the container 110 may have a raised outer edge 802 which may provide a stable foundation for the container 110.

Closure Manufacture

In a non-limiting embodiment, the closure system 100 can be manufactured by a blow molding process, including but not limited to, extrusion blow molding, injection blow molding, injection stretch blow molding, or any combination thereof. In one non-limiting embodiment the lid 200 may be manufactured at the same time as the container 110. Conversely, in another non-limiting embodiment, the lid 200 can be manufactured separately. In one embodiment, the manufacture of the product occurs via blow molding both the lid 200 and the container 110 at the same time.

In another non-limiting embodiment, the closure system 100 can be manufactured by an injection molding or rotational molding process.

In a non-limiting embodiment, material thickness is controlled by typical extrusion blow molding methods. As the plastic parison is extruded, the thickness is controlled by changing multiple programming points along the length of the parison. These thickness bands will result in the final container thicknesses after the parison inflates and stretches out to touch the mold surface.

In a non-limiting embodiment, the thickness of the plastic of the closure system is between about 0.1 mms and about 4 mms. In one embodiment, the thickness of the plastic is between about 1 mm and 2 mms. In a further embodiment, the thickness of the plastic is between about 1.2 mms and 1.8 mms.

Materials Used in Manufacture

The material employed in manufacturing the closure system 100 is any plastic or resin that may be used in a blow molding process. In non-limiting embodiments such materials may include polyethylene ("PET"), polyethylene naphthalate ("PEN"), High Density Polyethylene (HDPE), Low Density Polyethylene (LDPE), Polypropylene (PP), Polyvinyl Chloride (PVC), Thermoplastic Elastomers (TPE), Acrylonitrile Butadiene Styrene (ABS), Polyphenylene Oxide (PPO), Nylon/Polyamides (PA), Polycarbonate (PC), or combinations thereof. In addition, the container 110 can be mono-layered or multi-layered. In one embodiment, the material is High Density Polyethylene (HDPE).

In non-limiting embodiments, the closure system 100 may be manufactured using a recyclable PCR resin. As a result, the closure system 100 may be manufactured entirely of recycled materials. Conversely, the closure system 100 may be manufactured entirely of virgin materials. In addition, the closure system 100 may be manufactured partially of recycled materials and partially of virgin materials.

Exemplary Packaged Products

Because the closure system 100 is child-resistant, the container 110 may be filled with products that adults may not wish for children to handle or ingest. In non-limiting embodiments, the products that fill the container 110 may be chemicals, such as pool chemicals, laundry pods, pharmaceuticals, or any other dry product used within the chemical or food industries. The handle 206 enables the user to carry a great deal of weight thus making the closure system 100 ideal for heavy products on the market like cat litter and dry animal foods.

In a non-limiting embodiment, an induction seal may be applied to the opening 104.

Adjustable Force Required to Engage/Disengage Closure

By varying the length and taper-angle of the tapered section 112 and the type or thickness of the plastic used to manufacture the closure system 100, the force required to bypass the anchor 116 can be adjusted. For example, the force required to bypass the anchor 116 may be 8 pounds for one embodiment. By adjusting the length and taper-angle of the tapered section 112 and the type or thickness of plastic used, however, the force required to bypass the anchor 116 can be increased to 9, 10, 11, 12, 13, 14, 15, 16, 17, 18, 19, 20, 21, 22, 23, 24, or 25 pounds.

In a non-limiting embodiment, the closure system 100 is engaged by first contacting the lid 200 and the neck 102. The lid 200 is then rotated so that the nodes 204 pass between the first sections 118 of the anchors 116 in the direction of the axis 101. Applying a downward force on the lid 200 causes a deflection and/or deformation of the tapered section 112 and/or nodes 204 thereby permitting the nodes 204 to bypass the anchors 116. The lid 200 is then rotated so that the nodes 204 are beneath the undercut 120. Finally, the downward force is removed thereby permitting the tapered section 116 to return to its original shape and impart an upward force to engage the nodes 204 with the undercut 120.

To disengage the closure system 100 a downward force is needed to bypass the locking feature before the lid 200 can be rotated for removal.

In a non-limiting embodiment, the closure system 100 may be engaged by rotating the lid 200 clockwise in relation to the neck 102. Conversely, in another non-limiting embodiment, the closure system 100 may be engaged by rotating the lid 200 counter-clockwise in relation to the neck 102. In a non-limiting embodiment, the closure system 100 may be disengaged by applying a downward force to the lid 200 and simultaneously rotating the lid 200 clockwise in relation to the neck 102. Conversely, in another non-limiting embodiment, the closure system 100 may be disengaged by applying a downward force to the lid 200 and simultaneously rotating the lid 200 counter-clockwise in relation to the neck 102.

In summary, the present invention provides child-resistant and senior friendly features. The engagement of the closure system 100 is a push down and turn motion which audibly clicks in place when it is locked. The disengagement of the closure system 100 may require two simultaneous motions, a push-down motion and a turn-to-lock motion, thus becoming child-resistant.

Although illustrated and described above with reference to certain specific embodiments, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed is:

1. A closure system for a rigid plastic container, the closure system comprising:

a lid having a sidewall defining an inner surface, the inner surface including at least two nodes a distance apart that extend radially inward, a neck, defining an opening, the neck including:

a first end and a second end, wherein the first end is closer to the container than the second end, at least two anchors located a distance apart and extending radially outward from an outer surface of the neck, the anchors having (i) a first anchor part comprising an undercut, and (i) a second anchor part comprising a stop, the second anchor part adjacent to the first anchor part, wherein the anchors are located further from the first end than the beginning of a tapered section and are adapted to contact the tapered section when the lid is positioned with the nodes below the undercut, and the tapered section beginning at the first end, tapering towards the second end, wherein the tapered section is adapted to act as a spring and provides a bias force upon the nodes in a direction away from the container and towards the undercuts when the lid is positioned with the nodes below the undercuts.

2. The closure system of claim 1, wherein the tapered section tapers at an angle of between about 10 and about 25 degrees.

3. The closure system of claim 2, wherein the angle is about 18 degrees.

4. The closure system of claim 1, wherein the tapered section contains a curve.

5. The closure system of claim 1, wherein the closure system has a thickness of between about 0.1 mms and about 4 mms.

6. The closure system of claim 5, wherein the closure system has a thickness of about between about 1.2 mm and about 1.8 mms.

7. The closure system of claim 1, wherein the nodes are a height of between about 0.1 mms and about 10 mms from the inner surface of the sidewall.

8. The closure system of claim 1, wherein the anchors are a height of between about 0.1 mms and about 10 mms from the outer surface of the neck.

9. The closure system of claim 1, wherein a first section of the first anchor point is pitched towards the container.

10. The closure system of claim 1, wherein the nodes are pitched towards the top of the lid.

11. The closure system of claim 1, further comprising three or more anchors.

12. The closure system of claim 1, wherein the anchors are bayonet lugs.

13. The closure system of claim 1 further comprising a first lip connected to the second end and substantially perpendicular to the outer surface of the neck.

14. The closure system of claim 1, further comprising a handle, grip, notch, or any combination thereof attached to the lid.

15. The closure system of claim 1, further comprising the top of the lid having ribs for transmitting force applied in the direction of the container radially outward across the lid.

16. The closure system of claim 1, wherein the container is attached to the first end.

17. The closure system of claim 16, wherein the shape of the container is square, triangular, spherical, cylindrical, rectangular, oval, or free form.

18. The closure system of claim 1, wherein the outer surface of the lid is square, triangular, spherical, cylindrical, rectangular, oval, or free form.

19. The closure system of claim 1, further comprising lid stop extending inward from the inner surface of the lid and adapted to engage a container stop extending radially outward from the container wherein when the container stop is engaged with the lid stop further rotation of the lid is restricted.

20. The closure system of claim 1, wherein the distance between the anchors and the distance between the nodes is substantially equal.

* * * * *